US006481327B1

(12) United States Patent
Klukas et al.

(10) Patent No.: US 6,481,327 B1
(45) Date of Patent: Nov. 19, 2002

(54) REUSEABLE TRAINING DISPENSER

(75) Inventors: James A. Klukas, Victoria, MN (US); Michael A. Johnson, Chaska, MN (US)

(73) Assignee: Alliant Techsystems Inc., Hopkins, MN (US)

( * ) Notice: Subject to any disclaimer, the term of this patent is extended or adjusted under 35 U.S.C. 154(b) by 35 days.

(21) Appl. No.: 09/592,481

(22) Filed: Jun. 9, 2000

(51) Int. Cl.[7] ..... B64D 1/04; F41F 5/00
(52) U.S. Cl. ..... 89/1.51; 102/401
(58) Field of Search ..... 89/1.51; 102/401, 102/204

(56) References Cited

U.S. PATENT DOCUMENTS 2,502,442 A * 4/1950 Driskell ..... 102/6
3,500,409 A * 3/1970 Cash ..... 343/18
3,635,162 A * 1/1972 Lohkamp et al. ..... 102/7.6
4,466,332 A 8/1984 Van Sloun ..... 89/1.5 R
4,489,654 A * 12/1984 Van Sloun et al. ..... 102/204
4,557,177 A * 12/1985 Cheney ..... 89/1.51
4,712,478 A * 12/1987 Haglund et al. ..... 102/424
5,074,793 A 12/1991 Hambric et al. ..... 434/11
5,216,198 A * 6/1993 Bourgin ..... 102/401
5,359,917 A * 11/1994 Travor ..... 89/1.51
5,877,448 A 3/1999 Denton et al. ..... 102/401

* cited by examiner

*Primary Examiner*—Charles T. Jordan
*Assistant Examiner*—M Thomson
(74) *Attorney, Agent, or Firm*—George A. Leone

(57) ABSTRACT

A set of inert mines are loaded into a canister, where each of the inert mines includes a locating feature for a dispersion strap. A breech includes a reusable slider housing. A closure cap covers another end of the canister. An obturator is inserted into a breech end of the canister and connected as an interface between the canister and a breech. The dispersing strap is anchored to the breech where the dispersing strap is woven around the inert mines within the canister such that the strap traverses the locating feature of at least some of the inert mines so as to disperse the mines in a simulated mine dispersion pattern when the canister is fired.

12 Claims, 10 Drawing Sheets

REUSEABLE TRAINING DISPENSER

FIELD OF THE INVENTION

The present invention is generally related to munitions training apparatus and, more particularly, to a reuseable practice munition for distributing inert mines in a consistant mine field pattern.

BACKGROUND OF THE INVENTION

The armed forces are continually seeking training methods that are safe and inexpensive, yet closely represent tactical equipment use and performance. Currently, armed forces personnel use very unsophisticated methods for training personnel in the use of in rack mounted mine dispenser systems. As generally used in this specification the term "tactical" refers to a fully armed system having live mines and/or refers to parts employed in such tactical systems. The term "training" is used herein to denote inert systems used for training personnel in the use of the tactical systems. One example of a typical mine dispenser is broadly described in U.S. Pat. No. 4,466,332 to Van Sloun, issued Aug. 21, 1984 entitled Dispersing Mine Dispenser, all of the contents of which are incorporated herein by reference.

A prior training system incorporated a U.S. Army model M88 mine dispenser as a training canister. The prior M88 training canister dispensed cast aluminum dummy mines rather than tactical mines in an attempt to make training safer and more realistic. All other hardware in the M88 training canister, including the canister itself, was tactical U.S. Army model M87 hardware. The prior M88 training canister suffered from the significant drawback that it was not reusable. Demonstrations and training using such systems involving non-reuseable tactical hardware proved very expensive. As a result, the military forces have resorted to substituting less expensive training systems.

For example, in an effort to reduce costs, crude blocks of wood are hand tossed from trucks to represent mine locations. In such simulations, canisters are not actually fired, thus putting the trainees at risk for mistakes when they use a fully assembled and armed tactical system. In addition, such "training mine" locations are not indicative of a tactical minefield. Resulting safety and training issues indicate a heretofore unsatisfied need for inert equipment that demonstrates and trains users with regard to the safety features of the tactical equipment.

A motivation of the present invention is to provide a training system that is inexpensive because it employs reusable elements. Another motivation is to provide especially a system that does not require servicing by higher echelons and/or special maintenance facilities to prepare them for reuse. It is yet another motivation of the invention to provide a system that requires substantially less labor to assemble and use than currently known systems in order to reduce the costs associated with using such a system. At the same time, the present invention provides a more effective and more versatile training system that most closely resembles tactical use and performance of an actual tactical system.

SUMMARY OF THE INVENTION

In contrast to the prior art, the present invention provides a reusable training dispenser for dispensing simulated mines including a canister with a payload simulating tactical mines loaded into said canister. A breech includes a reusable slider housing mounted thereon, wherein the breech includes a keyed connector for quick connection to a fire pulse circuit. An obturator is connected as an interface between the canister and the breech.

In another embodiment, a plurality of inert mines are loaded into a canister in end-to-end relationship, where each of said plurality of inert mines includes a locating feature for a dispersion strap. A breech includes a reusable slider housing mounted thereon. A closure cap covers another end of said canister. An obturator is inserted into a breech end of said canister and connected as an interface between the canister and a breech. The dispersing strap is anchored to said breech where the dispersing strap is woven around said plurality of inert mines within the canister such that the strap traverses the locating feature of at least some of said plurality of inert mines so as to disperse said plurality of mines in a simulated mine dispersion pattern when said canister is fired.

One advantage of the invention is that it provides a significantly less expensive training system than taught by the prior art. The reloadable canister of the invention exhibits about a 10-time reduction in cost over using a tactical system loaded with dummy mines for training.

Another advantage of the invention is that it provides a training system canister that can be reloaded for use multiple times safely and reliably by armed forces users with minimal required training and using just a few common tools. The training canister can accommodate 20 or more uses and the most expensive non-explosive items of the training canister are reusable. Those items that are not reusable have been designed to be relatively inexpensive so that discarding them does not add undue cost. For example, the dispersion strap in the training system is significantly less expensive than a tactical system, because electrical signal communication required by the tactical hardware is not needed with the inert payload of the training system. At the same time the training system's strap maintains dispersion performance substantially equivalent to that of tactical dispersion systems.

It is another advantage of the present invention that the training system's reloadable canisters very closely match the performance of the tactical system canisters in all significant aspects, from size and shape to payload dispersion.

It is yet another advantage of the present invention that payload for the training canisters is flexible depending on training requirements. Inert dummy mines that match tactical mine dispersion most closely are most often used and are fully reusable. These can be replaced by, for example, sand mines that also resemble the tactical mine but are not reusable and degrade soon after deployment. Other payloads might include laser activated mines, paint ball mines, or weight-simulating slugs.

DETAILED DESCRIPTION OF THE PREFERRED EMBODIMENT

Figure 1:
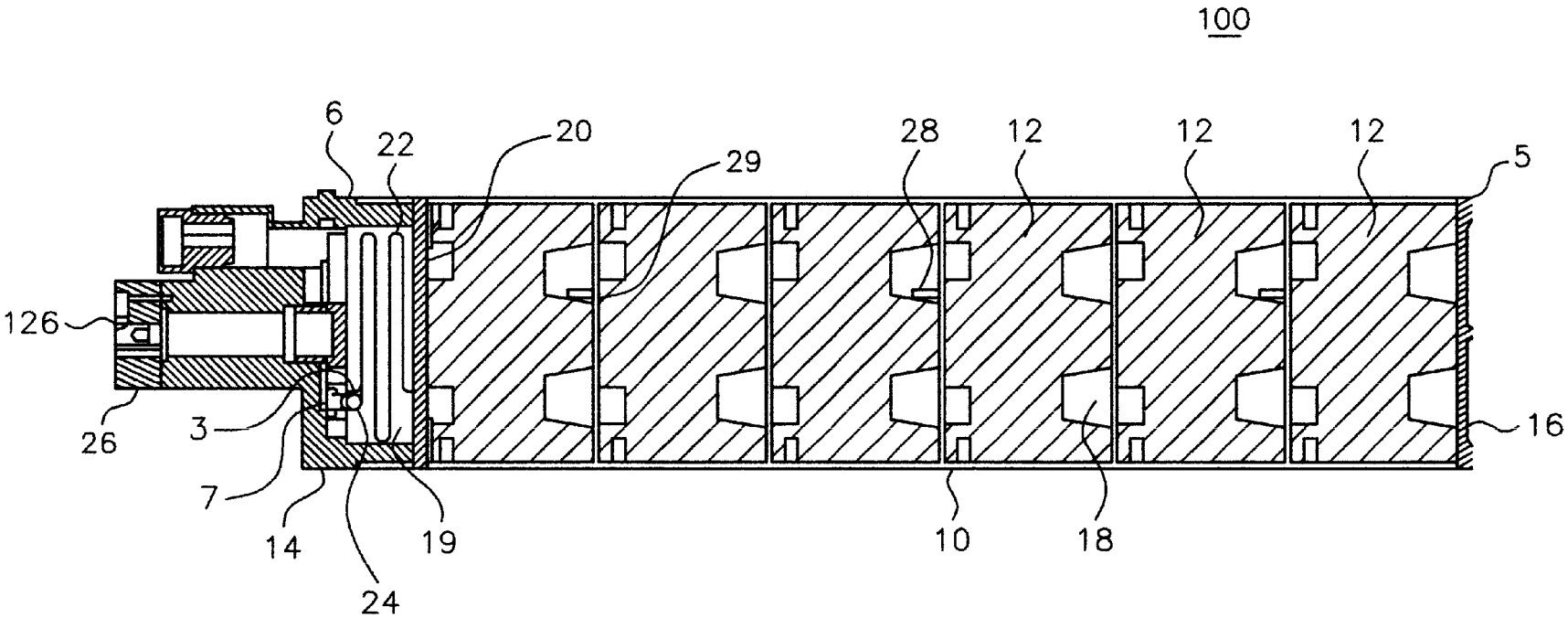
FIG. 1 is a schematic cut away view of an exemplary reusable training dispenser as employed in one embodiment of the invention.

While the invention will be described herein with respect to certain specific useful embodiments, it will be understood that these examples are by way of illustration and the invention is not limited by these examples. Referring now to FIG. 1, a schematic cut away view of an exemplary reusable training dispenser as employed in one embodiment of the invention is shown. A reusable training dispenser 100 includes a tube 10, a plurality of inert mines 12, a breech assembly 14, a closure cap 16, an obturator 20, a dispersing strap 22, an anchor 24, and a slider housing assembly 26.

The closure cap 16 is sealed with an o-ring 5 at the end of the tube 10. A blast shield 107 and the anchor 24 are affixed to the breech assembly 14 using screws or equivalent attachment means. The breech assembly 14 includes a breech o-ring 6 for providing a seal between the breech and tube. The strap 22 includes a loop 3 for attachment to the anchor 24. A cover plate 126 covers the slider housing 26.

In the reusable training dispenser 100, tactical mines are replaced with an inert payload. In a preferred embodiment the plurality of inert mines 12 comprise six (6) cast aluminum dummy mines loaded into the tube 10 in end-to-end relationship. The dummy mines are keyed for proper alignment to allow easy loading of the 6-mine stack into the tube. Each inert mine 12 includes a plurality of spring fingers 18. When loaded into the tube 10, each successive inert mine 12 is interlocked with the adjacent inert mine 12 by a means of an alignment mechanism 28. The alignment mechanism 28 is preferably a pin that is inserted into an alignment slot or hole 29 located at the bottom of each mine 12. Those skilled in the art will recognize that other payloads may also be employed. The payload could also be, for example, sand mines, laser activated mines, a single slug, or other payloads that simulate the weight of the tactical payload.

Figure 2:
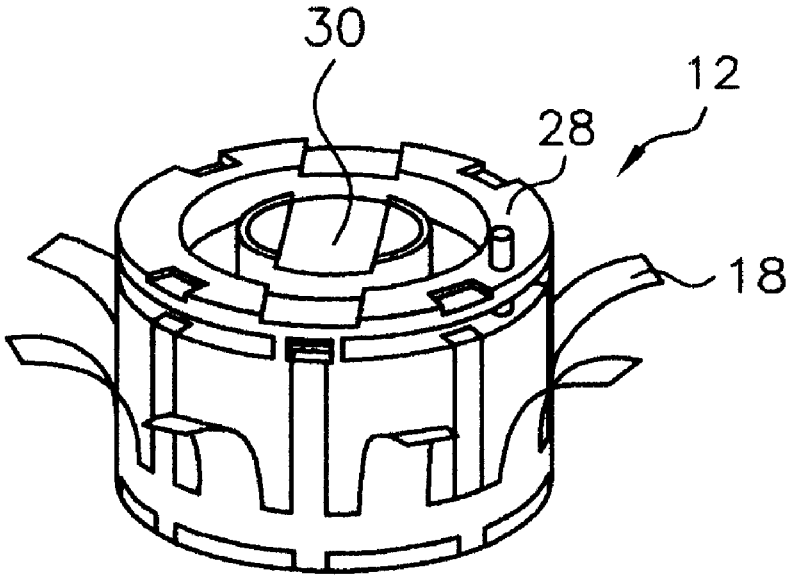
FIG. 2 is a more detailed schematic drawing of one type of inert mine used in one example of the invention shown.

Referring now to FIG. 2, a more detailed schematic drawing of one type of inert mine 12 used in one example of the invention shown. Details shown in FIG. 2 include a plurality of spring fingers 18, a centrally located slot 30, and alignment mechanism 28, namely an alignment pin in this example. The spring fingers 18 may comprise any suitable metal as used in the corresponding tactical mines.

Figure 3:
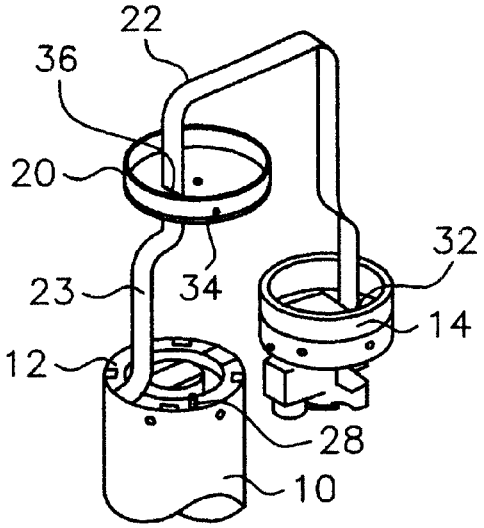
FIG. 3 is an exploded view of a schematic drawing showing the relationship of the obturator, tube, and breech before assembly for one example embodiment of the invention.

Referring now to FIG. 3, a schematic drawing shows the relationship of the obturator 20, tube 10, and breech assembly 14 during assembly in one example embodiment of the invention. The dispersing strap 22 is connected to the breech assembly 14 by anchor 24 (shown in FIG. 1). The dispersing strap 22 is then threaded through a slot 36 in the obturator 20. When assembled, the strap 22 is slotted through slot 30 on each inert mine 12. The obturator 20 includes an alignment hole 34 that aligns with pin 28 of the mine at the obturator end of the tube 10. The tube 10, obturator 20 and breech assembly 14 are assembled using screws, for example, or other reusable attachment means. Breech assembly 14 also includes an alignment slot 32 for aligning with pin 28.

Figure 4:
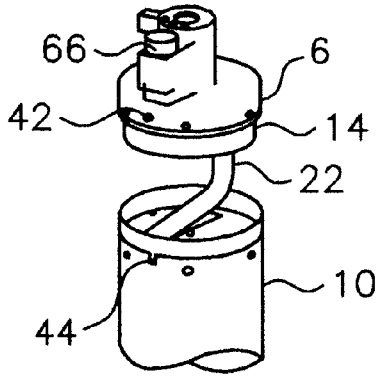
FIG. 4 is an exploded view of a schematic drawing showing the relationship of the tube and breech before assembly for one example embodiment of the invention.

Referring now to FIG. 4, a schematic drawing shows the relationship of the breech assembly 14 and a loaded tube 10 prior to assembly in one example embodiment of the invention. The breech assembly 14 includes a breech alignment pin 42 located to align the breech assembly 14 and slot 44 in tube 10 while maintaining a proper location for strap 22.

Figure 5:
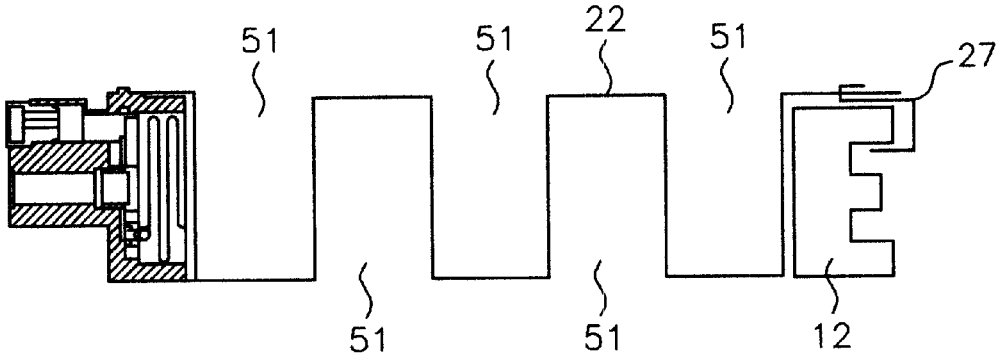
FIG. 5 is a schematic view of the dispersing strap configuration within the tube as used in one example of the invention.

A more detailed view of the weaving pattern of the dispersing strap 22 is shown below with reference to FIG. 5. There shown is the strap 22 as woven around the mines. For purposes of illustration, the first five mines are not shown, but if present, would occupy slots 51. The leading mine 12 nearest the cover is attached to the strap 22 by an attachment means, such as a hook 27. The hook 27 may be attached to the strap 22 through a slot 127. The hook 27 temporarily restrains the first launched mine 12 when fired so as to assure proper dispersion of the payload. Alternatively, a piece of Teflon® tape or an equivalent substance or device may be used for attachment to the mine 12.

The obturator 20 for an exemplary embodiment may preferably comprise a single, molded piece of polymeric material with few features. In relation to the tactical system, it is an inexpensive part that can be used once and replaced if necessary. While inexpensive, the polymeric material used in the obturator's fabrication still allows it to maintain its integrity under the expulsion gas pressure and temperature. The dispersing strap 22 may advantageously be made from standard webbing 23 (best shown in FIG. 3) with a sewn loop for attachment to the breech. The strap is prone to damage when the training system is fired, but is easily replaced and may be discarded after a single use. The webbing strap is also much easier to load into the canisters than the tactical strap because the critical alignment along the tactical strap for electronic communication is not necessary in the training munition.

Figure 10:
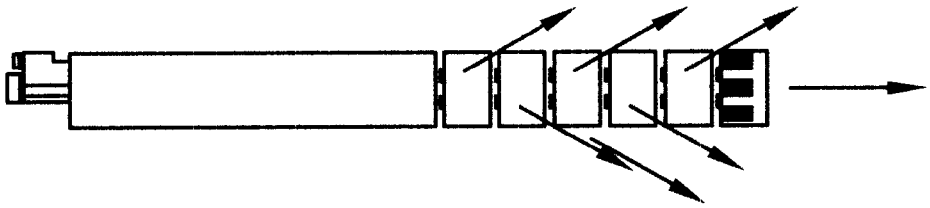
FIG. 10 shows a schematic view of a typical mine dispersing pattern.

As shown in FIG. 10, mine dispersion patterns substantially equivalent to tactical patterns are produced by the reusable training dispenser. The desired tactical pattern is replicated despite cost saving simplifications in the reloadable training system because the strap is still loaded into the canisters in the weaving pattern of the tactical canisters and attached to the breech block. The portion of the dispersing strap 22 that is subject to the expulsion gas is coated with a conformal coating such as, thinned silicone, so that it maintains its integrity to perform as an energy-absorbing tether and disperses the mines. A further innovation of the invention in order to maintain the correct dispersion is hooking the end of the strap to the first inert mine to exit the tube so that the strap is not pulled through the mine stack.

To operate in the same way as a tactical canister, the reuseable training canister receives a fire pulse from a launcher rack in which it is mounted. The launcher rack is a known assembly which is not shown in order to simplify and maintain focus upon the description of the invention. The electrical connection between the rack connector and the slider assembly to which the fire pulse is delivered is made in an exemplary reusable training dispenser with miniature connectors. The electrical connector design is novel and significantly different from the electrical connector design of the tactical version.

Figure 6:
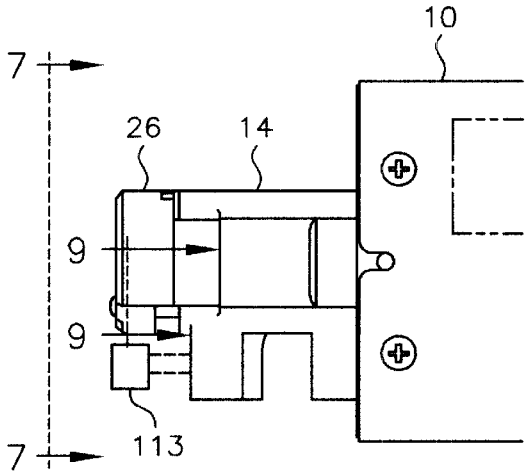
FIG. 6 shows a partial view of a tube assembly with a connected breech assembly as used in one example of the invention.

Referring now to FIG. 6, a partial view of a tube assembly with a connected breech assembly is shown. Connected to the breech assembly 14 is a slider housing 26. A top view is taken of the top of the slider housing 26 along lines 7—7. A removable shorting plug 113 may be inserted into connector 66 during reloading for safety reasons.

Figure 7:
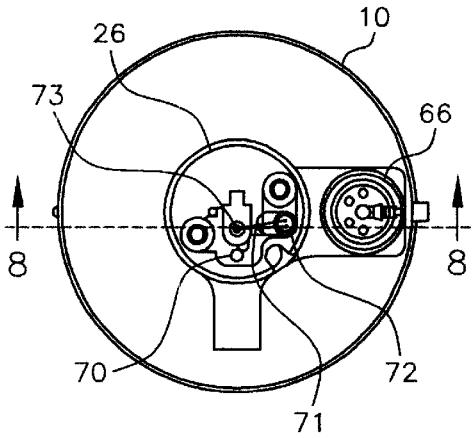
FIG. 7 is a top view of the breech assembly as used in one example of the invention.

Referring now to FIG. 7, a top view of the slider housing 26, as used in one example of the invention, is shown with the shorting plug 113, housing cover and screw removed. Assembled within the slider housing is a slider assembly 70. The slider assembly 70 includes a slider, an initiator 73, fire pulse wires 71, and a connector sleeve 72, that is terminated by mating plug connector 75. Fire pulse wires 71 are attached from the connector 75 to an initiator 73. A breech assembly receptacle connector 76 accepts the slider sleeve 72 and plug connector 75.

Figure 7C:
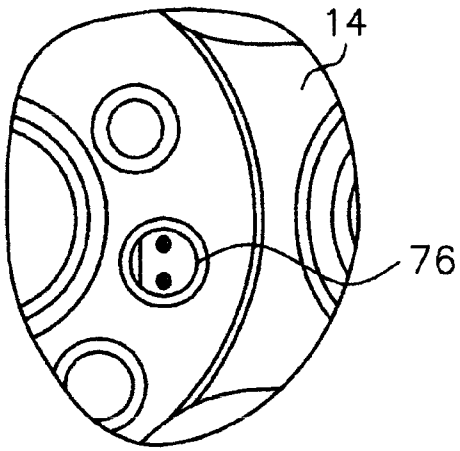
FIG. 7C is a more detailed view of a breech assembly receptacle connector.
Figure 7B:
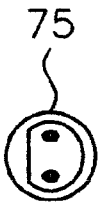
FIG. 7B features a D-shaped plug connector that allows easy orientation for reassembly.
Figure 7A:
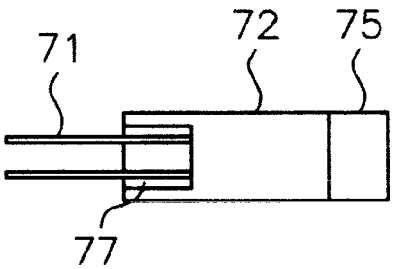
FIG. 7A shows a more detailed view of a connector sleeve and plug connector.

FIG. 7A shows a more detailed view of the connector sleeve 72 and plug connector 75. The connector sleeve 72 includes a cutout 77 for strain relief for the fire pulse wires 71 when the wires are bent over for insertion of the slider assembly into the slider housing. FIG. 7B features the D-shaped plug connector 75 that allows easy orientation for quick connection reassembly. FIG. 7C is a more detailed view of the breech assembly receptacle connector 76 that is also D-shaped for receiving the D-shaped plug connector 75. Other types of keying arrangements may be employed to allow quick connection of the fire pulse circuit to the breech assembly.

Figure 8:
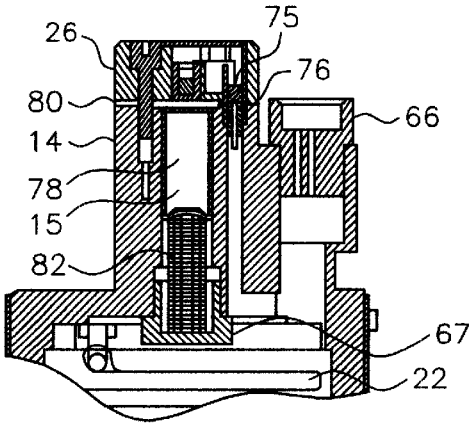
FIG. 8 shows a cut away view of the breech assembly shown in FIG. 7 as used in one embodiment of the invention.

Referring now to FIG. 8, a cut away view of the slider assembly shown in FIG. 7 is there shown as used in one embodiment of the invention. Assembled within a bore 15 within the breech assembly 14 are a pressure cartridge 78, a compression spring 82 and an orifice cup 67. A barrier 80 is placed between the slider housing 26 and the breech assembly 14.

Figure 9:
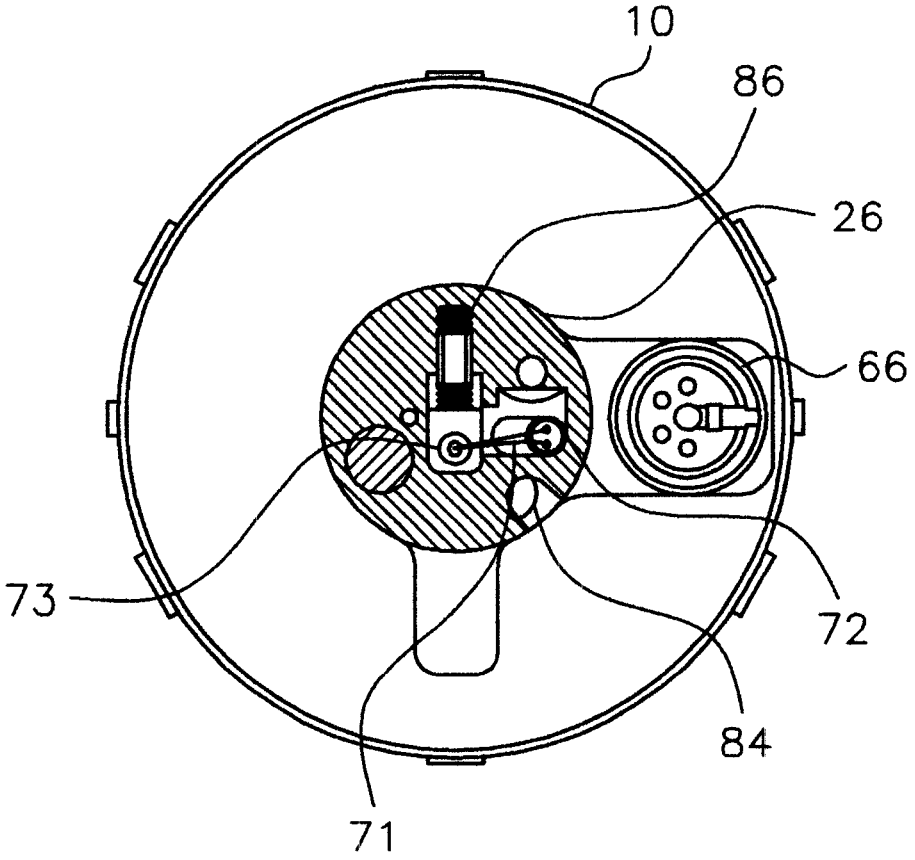
FIG. 9 is a detailed top view of a slider assembly and slider housing as taken along lines 9—9 of FIG. 6.

Referring now to FIG. 9, a detailed top view of the slider housing assembly 26 is shown as taken along lines 9—9 of FIG. 6. There shown in a top view is connector sleeve 72 having fire pulse wires 71 connected to the initiator 73 and bent over for assembly. Initiator 73 bears against a helical spring 86 to keep it in the out-of-line safe position when not installed in a launcher rack and armed. Plunger 84 may advantageously include a helical compression spring. Plunger 84 is aligned with a slot 85 in the slider housing 26. In operation, the slider assembly operates to fire the pressure cartridge 78 (as shown in FIG. 8) in order to fire the mine dispersion munition. The plunger is depressed by a mechanism in the launcher rack allowing the slider assembly to slide in line once armed by another mechanism in the launcher rack.

Refer now simultaneously to FIGS. 7–9 showing different views of the slider assembly and breech in a typical installation. The mating plug connector 75 is attached to the fire pulse wires 71 leading to an initiator 73. A sleeve 72 holds the connector 75 and fire pulse wires 71 so that the required electrical connection is made reliably. Orientation is important to prevent the fire pulse wires from becoming pinched and shorted. Since the slider assembly is an expended device in the canisters, it must be replaced each time a canister is fired. This electrical connection configuration renders the system, including the slider assembly housing 26, reusable so that reloading can be accomplished quickly and reliably. In one optional embodiment, the connector plug 75 may be delivered with a safety shorting shunt so that the slider assembly is always shorted during handling and assembly until the point when the electrical connection is made. While that connection is being made, however, there is still a short in the system preventing unwanted discharge, because another shorting plug 113 is connected to the rack connector 66 in the breech housing until the entire reloading is complete.

Referring again to FIGS. 1–5, the following steps describe assembly and/or reloading procedure for the reloadable training dispenser in an exemplary embodiment.

1. Four rivets 131 are inserted into holes 132 (as shown, for example, in FIG. 11) in the closure cap end of tube 10 and compressed until the rivets are retained.

2. The o-ring 5 is lubricated and mounted to the closure cap 16.

3. The closure cap is inserted at the end of tube 10.

4. The breech assembly 14 and obturator 20 with strap 22 are oriented such that the hole 34 in the obturator 20 lines up with slot 32 in the breech assembly 14.

5. The anchor 24 is inserted into the loop 3 in strap 22. The strap is kept untwisted from anchor to obturator.

6. The blast shield 107 and anchor 24 along with obturator 20 with strap 22 are affixed to the breech assembly 14 using screws.

7. Prior to inserting the first inert mine 12, the alignment pin is oriented to the 10 o'clock position relative to slot 44 of tube 10, where slot 44 defines the 12 o'clock position.

8. The hook 27 is attached to the strap 22 and hooked over the front corner of the leading mine. Then the strap 22 is placed in the slot at the 12 o'clock position. The strap is not to contain a twist, and the mine alignment pin is oriented at the 10 o'clock position. Slot 44 in tube 10 lines up with tape/strap at 12 o'clock position.

9. The strap is woven into mine slots as best shown in FIG. 5.

10. Alignment pins and slots for subsequent mines are similarly loaded leaving a short strap length.

11. Hole 34 in the obturator 20 mates to alignment pin 28 on the sixth mine 12 nearest the breech end of tube 10.

12. O-ring 6 is lubricated and affixed to the breech.

13. Pin 42 on breech assembly 14 is aligned with slot 44 in tube 10.

14. The strap 22 is folded into the breech cavity 19 and the breech is pressed into the obturator.

15. The breech is secured to the tube 10 using six screws.

Now referring to FIGS. 6–9, assembly of the slider housing into the breech proceeds according to the following steps.

1. Shorting plug 113 is inserted into connector 66.

2. The spring 86 is placed into the slider housing.

3. The slider assembly 70 is inserted into the slider housing 26.

4. Spring 82 is inserted into the breech bore 15.

5. The expulsion cartridge 78 with o-ring is loaded into breech bore 15 aligned with the spring 82.

6. The spring and plunger 84 are inserted into the breech.

7. Barrier 80 is positioned on the slider housing.

8. The plunger 84 is aligned to slot 85 in the slider housing.

9. The slider housing assembly is attached to the breech with two screws.

10. The slider connector plug 75 is pressed to engage it to the connector receptacle 76 in breech assembly 14.

11. The cover plate is attached to the slider housing.

Referring now to FIG. 10, a reusable training dispenser 100 is shown immediately after firing to illustrate a typical mine dispersion pattern. The dispersion pattern is indicated by directional arrows 110 showing the dispersion direction of each inert mine 12.

Figure 11:
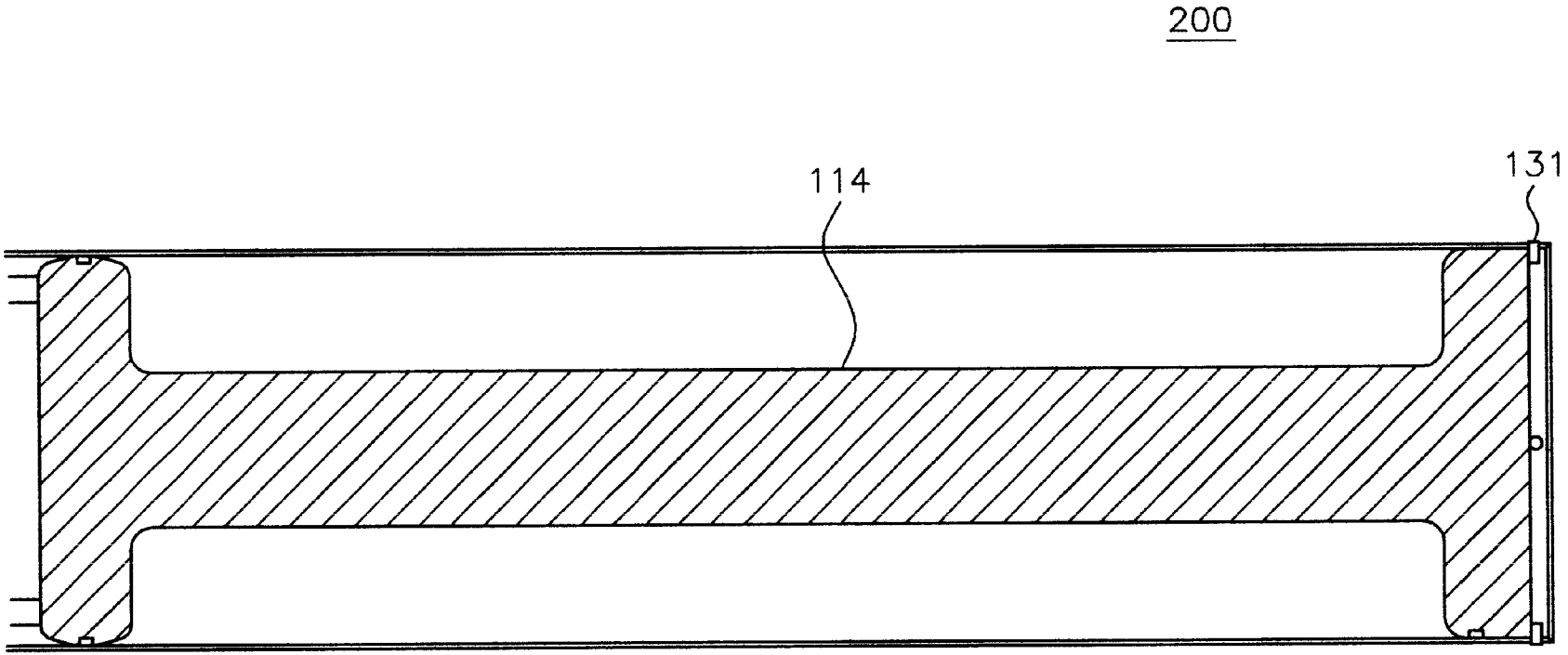
FIG. 11 is a schematic cut away view of an exemplary reusable training dispenser as employed in an alternate embodiment of the invention.

Referring now to FIG. 11, an alternate embodiment of the present invention is shown including a slug 114 loaded into canister 10. A slug matching the tactical weight can be used if tactical dispersion is not required. The slug facilitates ease in recovering hardware. In this alternate embodiment the use of the dispersion strap is eliminated since only the single slug is launched to simulate mine payload. One useful slug shape is a dumbbell shaped slug. Otherwise, the training dispenser 200 is constructed substantially in the same manner as described above.

Figure 12:
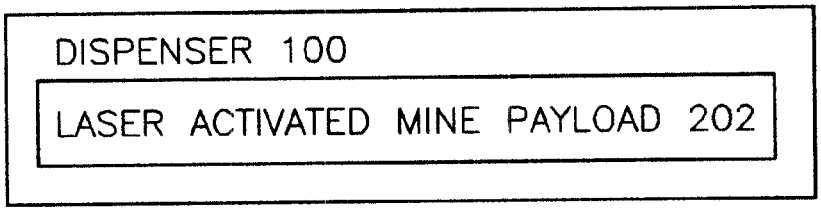
FIG. 12 shows a conceptional block diagram of another alternate embodiment of the present invention including a payload comprising a plurality of laser activated mines.
Figure 13:
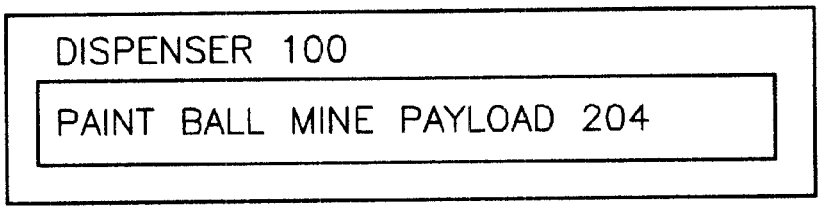
FIGS. 13 and 14 show conceptional block diagrams of a training dispenser in accordance with the present invention loaded with a plurality of paint ball mines and sand mines respectively.
Figure 14:
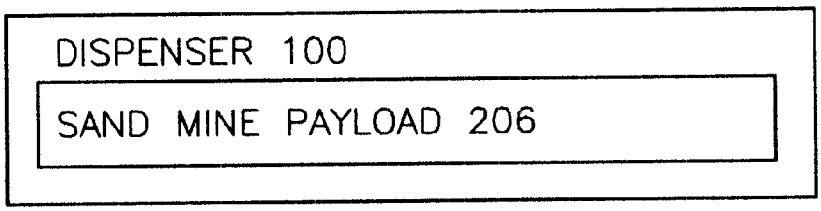

Referring now to FIG. 12, a conceptional block diagram of another alternate embodiment of the present invention is shown including a payload comprising a plurality of laser activated mines 202 loaded into dispenser 100. Laser activated mines are known and may be constructed with substantially the same shape as the inert mines 12. They are loaded into the dispenser in the manner described above with reference to the inert mines. Similarly, FIGS. 13 and 14 show conceptional block diagrams of a training dispenser 100 in accordance with the present invention loaded with a plurality of paint ball mines 204 and sand mines 206 respectively.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment and devices, and that various modifications, both as to the equipment details and operating procedures, may be accomplished without departing from the true spirit and scope of the present invention.

What is claimed is:

1. A reusable training dispenser for dispensing simulated mines comprising:

(a) a reusable canister;

(b) a payload simulating tactical mines loaded into said reusable canister;

(c) a breech including a reusable slider housing mounted thereon, wherein the breech includes a D-shaped breech assembly receptacle connector for quick connection to a fire pulse circuit D-shaped plug connector that allows orientation for quick connection reassembly, wherein the reusable breech includes also includes a rack connector; and (d) an obturator connected as an interface between the canister and the breech.

2. The reusable training dispenser of claim 1 wherein the payload comprises a plurality of inert mines loaded into said canister, where each of said plurality of inert mines includes a locating feature.

3. The reusable training dispenser of claim 2 further including a dispersing strap anchored to said breech where said dispersing strap is woven around said plurality of inert mines within the canister such that the strap traverses the locating feature of at least some of said plurality of inert mines so as to disperse said plurality of mines in a simulated mine dispersion pattern when said canister is fired.

4. The reusable training dispenser of claim 3 wherein said dispersing strap further includes a means for temporarily restraining the first inert mine launched of said plurality of inert mines.

5. The reusable training dispenser of claim 3 wherein said dispersing strap comprises nylon.

6. The reusable training dispenser of claim 1 wherein the payload comprises a plurality of sand mines.

7. The reusable training dispenser of claim 1 wherein said obturator comprises a polymer material.

8. The reusable training dispenser of claim 1 wherein said obturator comprises a single, molded piece of polymeric material.

9. A reusable training dispenser for dispensing simulated mines comprising:

(a) a canister;

(b) a payload simulating tactical mines loaded into said canister wherein the payload comprises a plurality of simulated mines, where each of said plurality of simulated mines includes a locating feature;

(c) a breech including a reusable slider housing mounted thereon, wherein the reusable slider housing includes a D-shaped breech assembly receptacle connector for quick connection to a fire pulse circuit D-shaped plug connector that allows orientation for quick connection reassembly, and wherein the breech includes also includes a rack connector;

(d) a closure cap covering one end of said canister;

(e) an obturator inserted into an opposite end of said canister and connected as an interface between the canister and the breech; and (f) a dispersing strap anchored to said breech where said dispersing strap is woven around said plurality of simulated mines within the canister such that the strap traverses the locating feature of at least some of said plurality of simulated mines so as to disperse said plurality of simulated mines in a simulated mine dispersion pattern when said canister is fired.

10. The reusable training dispenser of claim 9 wherein said dispersing strap further includes a means for temporarily restraining the first simulated mine launched of said plurality of simulated mines.

11. The reusable training dispenser of claim 10 wherein said dispersing strap comprises nylon.

12. The reusable training dispenser of claim 10 wherein the payload comprises a plurality of sand mines.

* * * * *